United States Patent [19]

Uchida

[11] Patent Number: 4,904,202

[45] Date of Patent: Feb. 27, 1990

[54] SPRING LOCKING DEVICE FOR CONNECTOR

[75] Inventor: Kanzaburo Uchida, Mooka City, Japan

[73] Assignee: Daiichi Denshi Kogyo Kabushiki Kaisha, Japan

[21] Appl. No.: 355,908

[22] Filed: May 23, 1989

[30] Foreign Application Priority Data

May 30, 1988 [JP] Japan ..... 63-70334[U]

[51] Int. Cl.[4] ..... H01R 13/62

[52] U.S. Cl. ..... 439/372; 285/320

[58] Field of Search ..... 439/347, 357, 352, 350, 439/351, 353, 354, 355, 356, 358, 369, 370, 372; 285/317, 315, 321, 320

[56] References Cited

U.S. PATENT DOCUMENTS

| | | | |
|---|---|---|---|
| 2,251,651 | 8/1941 | Ames et al. | 285/320 Y |
| 3,323,097 | 5/1967 | Tordoff | 439/370 |
| 3,858,915 | 1/1975 | Vincent et al. | 285/320 |
| 4,556,270 | 12/1985 | Schutzle et al. | 439/372 |
| 4,671,594 | 6/1987 | Ohtsuki et al. | 439/347 |

OTHER PUBLICATIONS

IBM Tech. Disclosure Bulletin "Plug-Retention Clip" vol. 28, No. 9, Feb. 1986.

*Primary Examiner*—William Briggs

*Attorney, Agent, or Firm*—Silverman, Cass & Singer

[57] ABSTRACT

A spring locking device prevents any disconnection of connected female and male connector members of a connector. The locking device includes two pairs of bearings provided on both ends of a mounting flange of one connector member and locking members having support pins rotatably supported in the bearings. Each of the locking members is made of a springy wire and includes two parallel legs having lower ends outwardly bent, and support pins continuous to the lower ends to provide bent corners therebetween. When the locking members are mounted in the bearings, the bent corners are positioned inside of the bearings and in contact with bottoms of the bearings, and the support pins are in contact with semicircular edges of the bearings and extend therefrom out of the bearings on sides opposite to those of the legs. The locking device can prevent the support pins from removing from the bearings in a reliable manner with the aid of the particularly formed locking members without using removal preventing members.

3 Claims, 4 Drawing Sheets

SPRING LOCKING DEVICE FOR CONNECTOR

BACKGROUND OF THE INVENTION

This invention relates to a spring locking device for a connector, which prevents connected male and female connector members of the connector from being disconnected as by external forces, and more particularly to a spring locking device for a connector, which prevents any disconnection of connected connector members of the connector and at the same time serves to reduce the number of parts of the connector.

For example, spring locking mechanisms as shown in FIGS. 1*a* and 1*b* have been widely used in order to prevent fitted connected male and female connector members from being disconnected by external tensile forces acting upon a connection cable and the like.

A locking member 1 of the spring locking mechanism as shown in FIG. 1 is made of a springy metal wire which is bent to have two support pins 1*a*, two legs 1*b* perpendicular to the support pins, and a rhombic latch portion 1*c* having a width wider than a distance between the two legs 1*b*. On the other hand, a mounting flange 2*a* of a metal shell 2 of a female member A is formed with bearings 2*b* which are formed by slitting and then raising parts of the flange 2*a* away therefrom by punching as shown in FIG. 1*b*. The locking members 1*a* are mounted to the female connector member A by inserting the support pines 1*a* into the bearings 2*b*.

Moreover, a mounting flange 3*a* of a metal shell 3 of a male connector member B is formed with leg guide slits 3*b* having a width narrower than the distance between the legs 1*b* and locking apertures 3*c* at inner ends of the leg guide slits 3*b* and continuous thereto. Diameters of the locking apertures 3*c* are larger than the width of the leg guide slits 3 but smaller than the width of the rhombic latch portion 1*c*.

When the female and male connector members have been fitted and connected, the locking member 1 are turned with the rhombic latch portions 1*c* against their spring forces so that the legs 1*b* are forced through the leg guide slits 3*b* and positioned in the locking apertures 3*c*. The legs 1*b* of the locking member 1 are once narrowed by the leg guide slits 3*b* and again permitted to expand in the locking apertures 3*c* by their spring forces, so that the locking members 1 are prevented from being removed through the leg guide slits 3*b* and further resist to any external pulling forces with the aid of the rhombic latch portions 1*c* wider than the locking apertures 3*c*. The connected female and male connector members are thus prevented from being disconnected by external forces.

With the spring locking mechanism of the prior art as above described, after the rhombic latch portions 1*c* of the locking members 1 have been pressed inwardly to narrow the distances between the legs 1*b*, the support pins 1*a* of the locking members 1 are positioned between the bearings 2*b* of the female connector member A and the rhombic latch portions 1*c* are then released. As a result, the legs 1*b* expand by their springy return forces to insert the support pins 1*a* into the bearings 2*b*.

In the arrangement of the locking mechanism of the prior art, the locking members 1 are likely to be removed from the connector because the support pins 2*a* are apt to be dislodged from the bearings owing to narrowed distances between the legs 1*b* and other reasons for example when the legs 1*b* are inserted in the leg guide slits 3*b* for locking.

In order to overcome this problem, in the prior art for example as shown in FIGS. 3*a*–3*c* a removal preventing projection 4 is provided between the two bearings 2*b* and legs 1*b* of locking members 1 are bent as shown at 1*b* in FIG. 4*b* which is a side view of the locking member 1 of FIG. 4*a*. Therefore, when the legs 1*b* are inserted in the leg guide slit 3*b*, the removal preventing projection 4 is positioned between the bottoms of the legs 1*b* to prevent any removal of the support pins 1*a* from the bearings 2*b*.

In such a solution, however, a metal plate 5 is separately needed which has bearings 2*b* and removal preventing projections 4 by punching and bending. The metal plate 5 is then fixed to the mounting flange 2*a* of the connector member by means of eyelets or the like as shown in FIG. 3*a*. As an alternative, an insulating block 6 of a connector member is formed integrally with removal preventing projections 4 so that when a mounting flange 2*a* is secured on the insulating block 6, the removal preventing projections 4 extend beyond the mounting flange 2*a* through apertures previously formed in the mounting flange 2*a* as shown in FIG. 3*b* or 3*c*.

Therefore, the number of parts constituting the connector is increased and dies for molding the insulating block 6 are complicated to increase manufacturing cost of the connector.

SUMMARY OF THE INVENTION

It is a primary object of the invention to provide an improved spring locking device for a connector, which eliminates all the disadvantages of the prior art and can prevent any unintentional removal of locking members from the connector in a reliable manner without using removal preventing projections 4 to reduce manufacturing costs of the connector.

In order to achieve the object, in a spring locking device for a connector including a female connector member and a male connector member, said spring locking device including two pairs of bearings arranged on both ends of a mounting flange of one connector member, respectively, each of the bearings having openings in directions substantially perpendicular to longitudinal directions of the one connector member and having a semicylindrical inner surface, and locking members made of a springy wire, each locking member having two legs spaced in parallel with each other and two support pins formed by bent outwardly relative to the legs and rotatably supported in said one pair of bearings, thereby locking the two connector members by turning the locking members into slits formed in the other connector member after the two connector members are connected, according to the invention each of the locking members comprises the legs having lower ends outwardly bent and the support pins continuous to the lower ends and having bent corners between the lower ends and the support pins, and said bent corners are positioned inside of the bearings and in contact with bottoms of the bearings and said support pins are in contact with semicircular edges of the bearings and extend therefrom out of the bearings on sides opposite to those of the legs when the locking members are mounted in the bearings.

With this arrangement, the spring locking device according to the invention can prevent the support pins of the locking members from removing from the bearings in a reliable manner by simply modification of the locking members without using removal preventing projections. Therefore, reduction in number of parts and simplification of dies for molding insulating housings can be accomplished, thereby lowering the manufacturing cost of connectors.

In a preferred embodiment of the invention, the mounting flange is provided with stopper members having heights from the mounting flange and facing to openings of the bearings in opposition to each other and positioned in the proximity of the openings.

In a further embodiment, the bearings are formed by slitting and then raising parts of the mounting flange, and edges of cut portions caused by raising the slit parts are the stopper members.

The invention will be more fully understood by referring to the following detailed specification and claims taken in connection with the appended drawings.

DETAILED EXPLANATION OF THE PREFERRED EMBODIMENTS

According to the invention, locking members are particularly formed in construction to ensure the prevention of removal of the locking device for a connector.

Figure 1B:
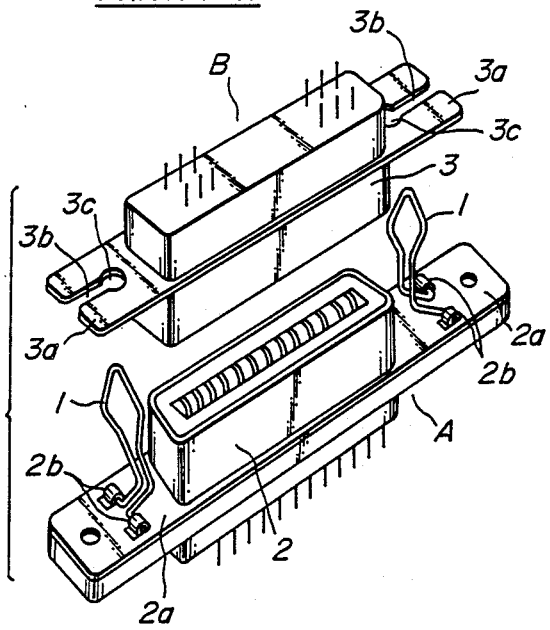
FIG. 1b PRIOR ART
FIGS. 1*a* and 1*b*, 2*a* and 2*b*, 3*a* 3*c* and 4*a* and 4*b* are explanatory views of a locking device of the prior art.
Figure 1A:
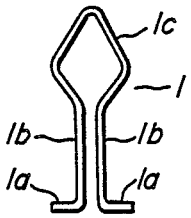
FIG. 1a PRIOR ART
Figure 2B:
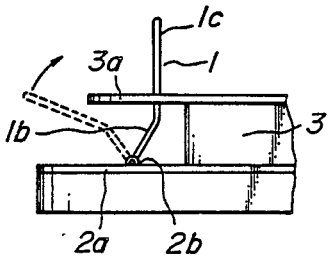
FIG. 2b PRIOR ART
Figure 2A:
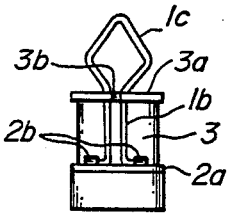
FIG. 2a PRIOR ART
Figure 3A:
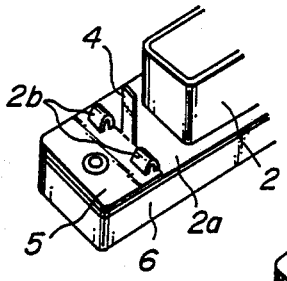
FIG 3a PRIOR ART
Figure 3B:
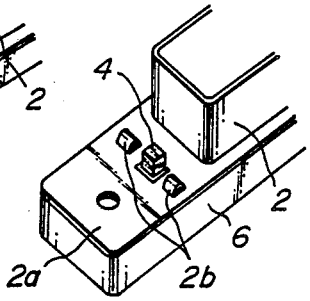
FIG 3b PRIOR ART
Figure 3C:
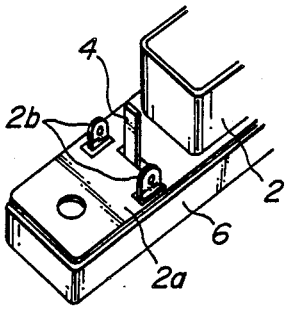
FIG 3c PRIOR ART
Figure 4A:
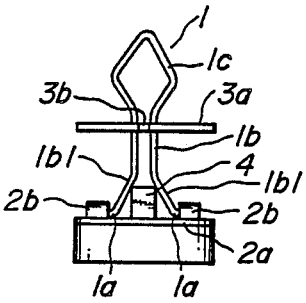
FIG 4a PRIOR ART
Figure 4B:
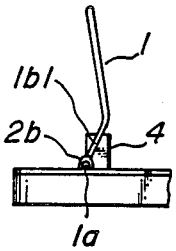
FIG 4b PRIOR ART
Figures 5A, 5B:
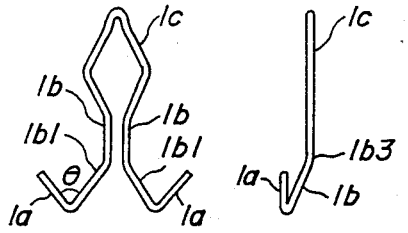
FIGS. 5*a*–5*d* are explanatory views of one embodiment of a spring locking device for a connector according to the invention.
Figures 5C, 5D:
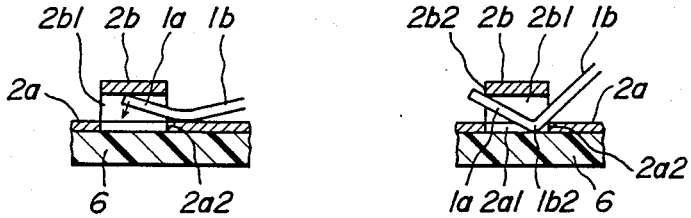

Referring to FIGS. 5*a*, 5*b* and 5*c*, each of the locking members comprises legs 1*b* having lower ends 1*b*1 outwardly bent at an angle and support pins 1*a* continuous to the lower ends 1*b*1 and bent directing upwardly and outwardly. A bent corner 1*b*2 of each of the support pins 1*a* continuous to the lower end 1*b*1 of the leg 1*b* is positioned inside of the bearing 2*b* and in contact with a bottom of the bearing 2*b*. On the other hand, each of the support pins 1*a* extending from the bent corner 1*b*2 is in contact with a semicircular edge 2*b*2 of the bearing 2*b* and extends therefrom out of the bearing 2*b* on a side opposite to that of the leg 1*b*.

Figure 8:
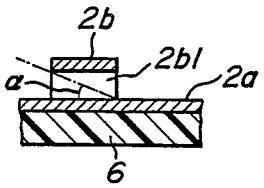
FIG. 8 is an explanatory view for a relation between the locking member and the bearing of the device according to the invention.

In this case, an angle of the support pin 1*a* extending outwardly and upwardly with a horizontal may be equal to or slightly larger than an angle $\alpha$ shown in FIG. 8 which is an angle of a diagonal (shown in a dot-and-dash line) of a rectangle of the bearing in section with a mounting flange 2*a*. It becomes from the reason that the bent corner 1*b*2 is positioned inside of the bearing 2*b* and 2*b*, while the support pin 1*a* is in contact with the semicircular edge of the bearing 2*b* and extends therefrom.

The lower end 1*b*1 of the leg 1*b* is bent outwardly at an angle such that insertion of the bent corner 1*b*2 into the bearing 2*b* is not obstructed by a semicircular edge on opposite side of the semicircular support pin 1*a*.

When the legs 1*b* expand outwardly, they abut against the edges of the bearings to prevent further outward expansion of the locking member. If the lower ends 1*b*1 are bent at a large angle so as to bring the lower ends 1*b*1 into parallel with the flange 2*a*, they do not serve to prevent such a further expansion of the locking member 1. Therefore, such a large angle of the lower ends of the legs is not preferable.

In a particular case, the locking member 1 may be constructed as follows. As shown in FIG. 5*a*, two legs 1*b* of a locking member 1 are bent outwardly, and support pins 1*a* are formed by bending it upwardly at an acute angle $\theta$ with the lower ends 1*b*1 of the legs 1*b*. Distances between two bearings 2*b* are so selected that the support pins 1*a* can be inserted into the bearings 2*b* by narrowing the distance between the legs 1*b*, thereby providing reaction spring forces to open the legs 1*b* outwardly.

The length and the bent angle of the support pins 1*a*, the length of the bearings 2*b*, the inner diameter of the bearing apertures 2*b*1 and the spring force of the wire of the locking members 1 are so selected that when the support pins 1*a* are inserted in the bearing apertures 2*b*1 as shown in FIG. 5*d*, the support pins 1*a* are urged downwardly by inner upper surfaces of the bearing apertures 2*b* 1 so as to be deformed to produce reaction spring forces, and that when the insertion of the support pins 1*a* has been completed, tip ends of the support pins 1*a* are pressed against pressing edges 2*b*2 by reaction spring forces while the tip ends of the support pins 1*a* extend out of the bearings 2*b* as shown in FIG. 5*c*.

In this case, moreover, as shown in FIG. 5*c*, the bent corner 1*b*2 between the support pin 1*a* and the leg 1*b* is firmly in contact with a surface of the insulating housing 6 by the reaction spring force of the locking member 1. The surface of the insulating housing 6 in question is exposed as a bottom of the bearing 2*b* by forming the bearing 2*b* by slitting the mounting flange 2*a* fixed to the insulating housing 6 and then raising the slit portion away from the mounting flange 2*a*. Moreover, when a force acts on the support pin 1*a* so as to remove it from the bearing 2*b*, a portion near to the bent corner 1*b*2 abuts against a edge 2*a* 2 portion 2*a* l as a stopper member facing in a direction opposite to the possible removing direction of the support pin 1*a*.

Figure 7:
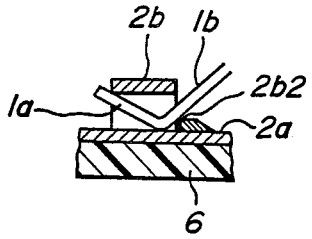
FIG. 7 is a view of a modification of the locking device according to the invention.

FIG. 7 illustrates one embodiment of the device according to the invention. A mounting flange 2*a* is provided with stopper members 2*b*2 having a height from the mounting flange 2*a* and facing to the openings of the bearings and in the proximity of the openings facing toward each other. The height of the stopper members 2*b*2 is sufficient to be of the order of one third of a diameter of the wire of the locking member 1. An attachment of the stopper members 2*b*2 is preferably effected by an adhesive or by spot welding.

With the spring locking device according to the invention constructed as above described, even if the distance between the two legs 1*b* of the locking member 1 is narrowed to cause the support pins 1*a* to remove from the bearings 2*b* in case for example that the legs 1*b* are forced into the leg guide slit 3*b* of a mating connector, the bent corner 1*b*2 or its near portion abuts against the stopper member 2*a*2 to resist the removing force acting upon the locking member 1 because the support pins 1*a* are sliding along and depressed by the semicircular edges 2*b*2 of the bearing 2*b*. Therefore, the removal of the support pins 1*a* from the bearings 2*b* is completely prevented without using the removal preventing projections 4 used in the prior art.

In the embodiment above described, the locking member includes bent portions 1b3 at which the legs 1b are bent forwardly as shown in FIG. 5b. Such bent portions 1b3 may be dispensed with because having no removal preventing projections 4 in the invention.

EXAMPLES

Figure 6C:
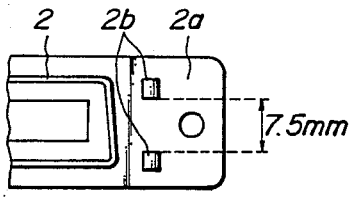
FIGS. 6*a*–6*d* are views illustrating examples of dimensions of the locking member and the bearing of the locking device according to the invention.
Figure 6D:
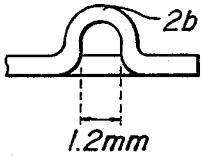
Figures 6A, 6B:
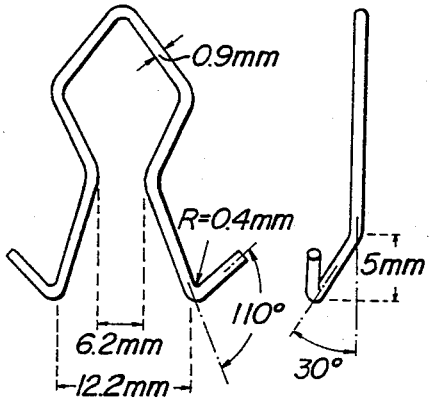

FIGS. 6a and 6b illustrate a locking member 1 and FIGS. 6c and 6d show bearings 2b of one example of the locking device according to the invention.

The bearing 2b had a bearing aperture 2b1 whose diameter was 1.2 mm and length was 2 mm. A mounting flange 2a for a shell had a thickness of 0.5; mm. The bearings 2b were arranged spaced apart 7.5 mm.

The locking member 1 was made of a stainless steel having a diameter of 0.9 mm and formed in a shape as shown under a completely relaxed condition in FIGS. 6a and 6b. When the locking member 1 was mounted condition between the bent corners 1b2 of the deformed locking member 1 became substantial equal to 7.5 mm which was the distance between the bearings 2b.

As can be seen from the above description, the spring locking device according to the invention can prevent the support pins of the locking members from removing from the bearings in a reliable manner by simply modification of the locking members without using removal preventing projections. Therefore, reduction in number of parts and simplification of dies for molding insulating housings can be accomplished, thereby lowering the manufacturing cost of connectors.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A spring locking device for a connector including a female connector member and a male connector member, said spring locking device including two pairs of bearings arranged on both ends of a mounting flange of one connector member, respectively, each of the bearings having openings in directions substantially perpendicular to longitudinal directions of the one connector member and having a semicylindrical inner surface, and locking members made of a springy wire, each locking member having two legs spaced in parallel with each other and two support pins bent outwardly relative to the legs and rotatably supported in said one pair of bearings, thereby locking the two connector members by turning the locking members into slits formed in the other connector member after the two connector members are connected, wherein each of the locking members comprises the legs having lower ends outwardly bent and the support pins continuous to the lower ends and having bent corners between the lower ends and the support pins, and said bent corners are positioned inside of the bearings and in contact with bottoms of the bearings and said support pins are in contact with semicircular edges of the bearings and extend therefrom out of the bearings on sides opposite to those of the legs when the locking members are mounted in the bearings.

2. A spring locking device for a connector as set forth in claim 1, wherein said mounting flange is provided with stopper members, said stopper members having heights from the mounting flange and facing to openings of the bearings in opposition to each other and positioned in the proximity of the openings.

3. A spring locking device for a connector as set forth in claim 2, wherein said bearings are formed by slitting and then raising parts of the mounting flange, and edges of cut portions caused by raising the slit parts are said stopper members.

* * * * *

UNITED STATES PATENT AND TRADEMARK OFFICE

CERTIFICATE OF CORRECTION

PATENT NO. : 4,904,202

DATED : February 27, 1990

INVENTOR(S) : Kanzaburo Uchida

It is certified that error appears in the above-identified patent and that said Letters Patent is hereby corrected as shown below:

Column 1, line 25, after "female" insert "connector";

Column 3, line 60, after "and" insert "in contact with the bottom of the bearing";

Column 3, line 66, after "semicircular" insert "edge 2b2 of the bearing to be in contact with the";

Column 4, line 42, after "2a2 insert "of the removed";

Column 5, line 18, after "mounted" insert "in the bearings 2b, the distance 12.2 mm in the relaxed".

Signed and Sealed this

Third Day of March, 1992

*Attest:*

HARRY F. MANBECK, JR.

*Attesting Officer*

*Commissioner of Patents and Trademarks*